United States Patent [19]

Katoh et al.

[11] Patent Number: 4,696,561

[45] Date of Patent: Sep. 29, 1987

[54] FIXING ROLLER PRESSING MECHANISM FOR COPYING MACHINES

[75] Inventors: Tutomu Katoh; Hiranaga Yamamoto, both of Yamatokoriyama, Japan

[73] Assignee: Sharp Kabushiki Kaisha, Osaka, Japan

[21] Appl. No.: 819,101

[22] Filed: Jan. 15, 1986

[30] Foreign Application Priority Data

Jan. 22, 1985 [JP] Japan ..... 60-7799[U]

[51] Int. Cl.[4] ..... G03G 15/20

[52] U.S. Cl. ..... 355/3 FU; 219/216

[58] Field of Search ..... 355/3 R, 3 FU, 14 FU; 219/216, 469, 470

[56] References Cited

U.S. PATENT DOCUMENTS

| | | | |
|---|---|---|---|
| 3,484,326 | 12/1969 | Grandinetti | 219/469 X |
| 4,147,501 | 4/1979 | Goshima et al. | 219/469 X |
| 4,285,295 | 8/1981 | Iwao et al. | 355/3 FU X |
| 4,384,781 | 5/1983 | Takada | 355/3 FU |
| 4,589,758 | 5/1986 | Kasama et al. | 355/3 FU |

FOREIGN PATENT DOCUMENTS

| | | |
|---|---|---|
| 2936978A1 | 3/1980 | Fed. Rep. of Germany . |
| 3018853A1 | 11/1980 | Fed. Rep. of Germany . |
| 3439132A1 | 5/1985 | Fed. Rep. of Germany . |

OTHER PUBLICATIONS

English translation of the Official German Action of Nov. 11, 1986.

Partial English translation of German Document DE 30 18 853.

*Primary Examiner*—Fred L. Braun

*Attorney, Agent, or Firm*—Birch, Stewart, Kolasch & Birch

[57] ABSTRACT

A fixing-roller pressing mechanism for a copying machine containing the following: upper and lower fixing rollers; a lower frame flexibly held by the lower half of the copying machine, which is split into upper and lower halves, so that the lower frame can move vertically and pivotally hold the lower roller; an upper frame pivotally held by the lower half so that it can rotate and pivotally hold the upper roller; a member installed in the upper half, which causes the upper roller to press against the lower roller via the upper frame when the upper half is closed; and retention system installed between the lower and upper halves, which causes the upper roller to remain in the half-pressed state against the lower roller when the upper half is open.

3 Claims, 6 Drawing Figures

FIXING ROLLER PRESSING MECHANISM FOR COPYING MACHINES

BACKGROUND OF THE INVENTION

The present invention relates to the roller pressing mechanism of a copying machine, more particularly, to the roller pressing mechanism that allows the fixation-use upper roller to remain in the half-pressing position against the lower roller.

In some conventional copying machines, the fixing roller is composed of an upper and a lower roller that remain in contact with each other by the application of a specific amount of pressure. However, if the copying paper becomes clogged in the fixing mechanism, the copying paper cannot be smoothly removed from the machine due to the fixing pressure. There are, however, some copying machines that are divided into upper and lower halves. In these machines, the upper half applies its own weight to the upper roller so that this roller presses against the lower only when the upper half is closed. In such machines, it is easy to draw out clogged paper by raising the upper half. However, as shown in FIG. 6, unless the upper roller (101) receives load W from the upper half, the upper roller remains in a position so that it can move with the upper frame (102) as the frame pivots on its shaft (103). In other words, when the upper half is raised, the upper roller (101) contacts the lower roller (104) by means of its own weight. However, insufficient contact pressure eventually causes toner to transfer to the upper roller (101) and unavoidably stains the following copies.

SUMMARY OF THE INVENTION

The present invention is designed to provide a copying machine with a useful fixing roller pressing mechanism that allows clogged paper to be easily removed from the fixing rollers. It also prevents copies from being stained by toner adhering to the upper roller.

Other objects and the further scope of application of the present invention will become apparent from the detailed description given hereinafter. It should be understood, however, that the detailed description and specific examples, while indicating the preferred embodiments of the invention, are given by way of illustration only, since various changes and modifications within the spirit and scope of the invention will become apparent to those skilled in the art from the following detailed description.

To realize the above objects according to one of the preferred embodiments of the present invention, the copying machine is divided into an upper and a lower half. The upper roller presses against the lower roller when the upper half is closed. A copying machine incorporating the preferred embodiment of the present invention provides means between the lower and the upper halves, whereby the upper roller continuously presses at a semi-pressure condition against the lower roller even when the upper half is open.

BRIEF DESCRIPTION OF THE DRAWINGS

The present invention will be better understood from the detailed description given hereinbelow and the accompanying drawings are given by way of illustration only, and thus are not limitative of the present invention in which.

DETAILED DESCRIPTION OF THE PREFERRED EMBODIMENTS

Figure 1:
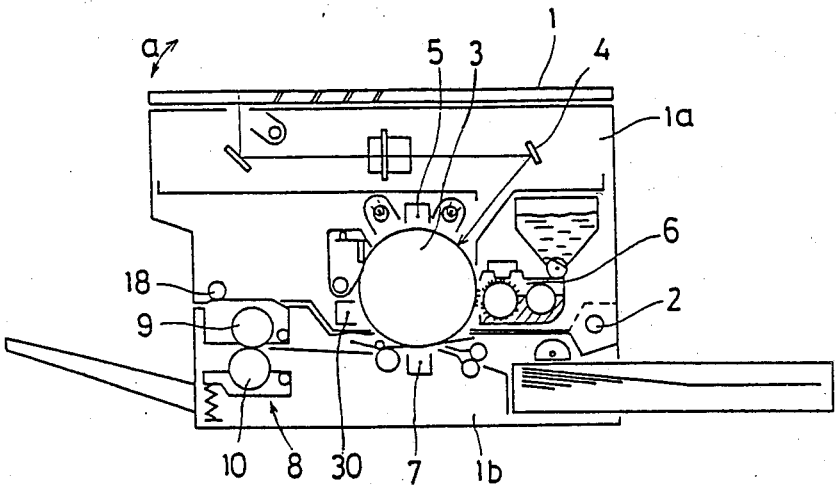
FIG. 1 is a simplified schematic diagram of a copying machine incorporating the fixing roller pressing mechanism embodied by the present invention.

FIG. 1 is a simplified schematic diagram of the roller pressing mechanism embodied by the present invention, which is applied to the fixing roller of a copying machine.

In FIG. 1, a copying machine (1) is divided into an upper half (1*a*) and a lower half (1*b*). The upper body (1*a*) is designed so that it contacts the lower body (1*b*) and opens and closes in the direction of arrow "a" via a pivot (2). The upper half (1*a*) is internally provided with a exposure drum (3) and optical instruments (4) for the exposure operation. A charger (5), a developer (6), an image transfer unit (7), and a discharger are installed along the periphery of the exposure drum (3). The fixing roller pressing mechanism (8) reflecting the preferred embodiment of the present invention is installed to the left of the exposure drum (3). Details of the fixing roller pressing mechanism (8) are described below with reference to FIGS. 2 and 3.

Figure 2:
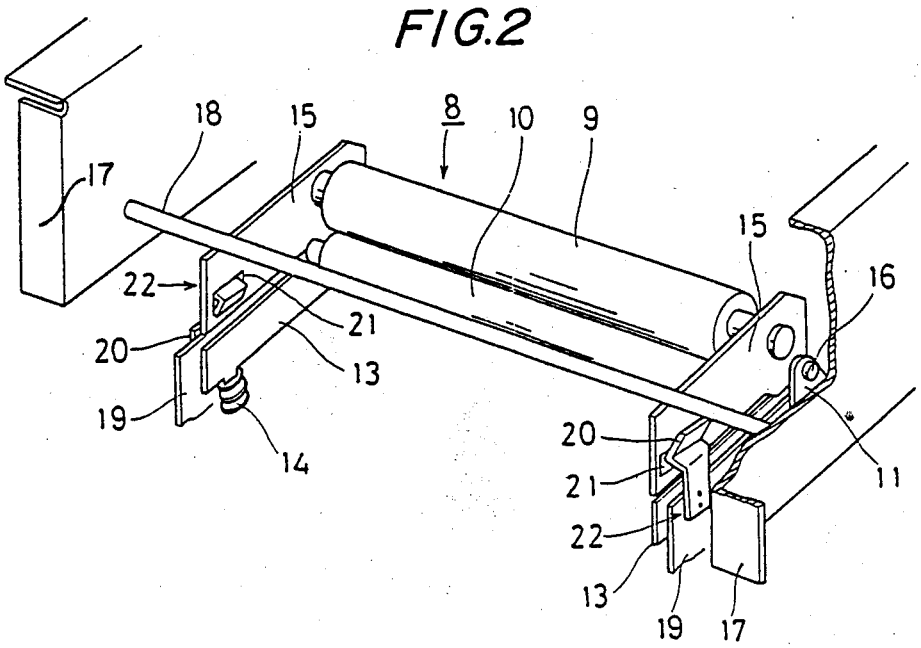
FIGS. 2 and 3 are the perspective and sectional views, respectively, of the fixing roller pressing mechanism embodied by the present invention.
Figure 3:
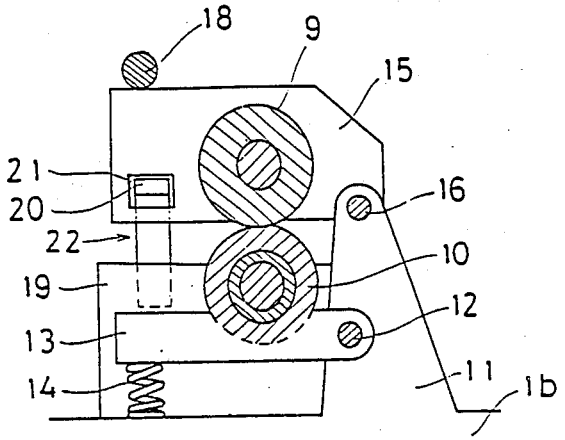
Figure 4:
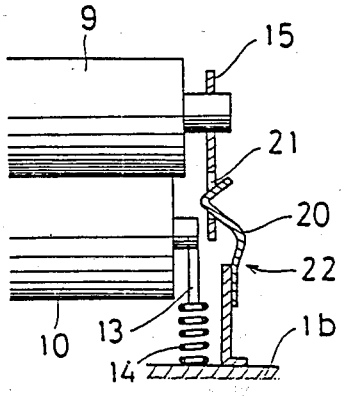
FIG. 4 is a schematic diagram illustrating the key parts of the roller pressing mechanism that contact the fixing roller.
Figure 5:
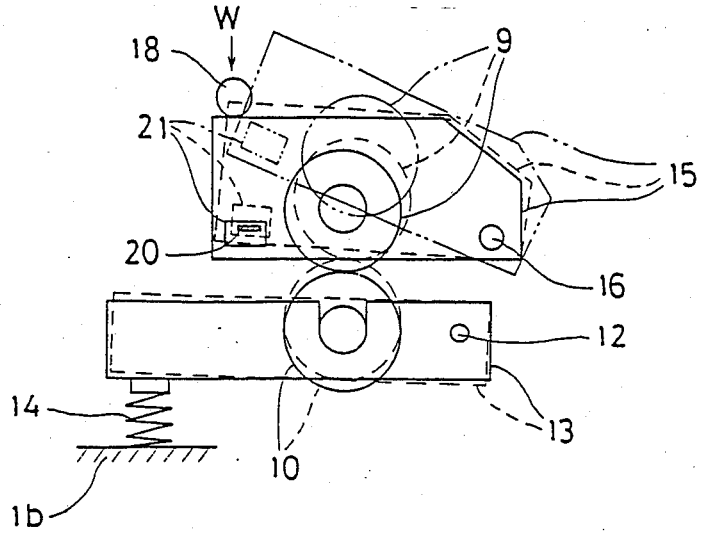
FIG. 5 is a schematic diagram illustrating the operation of the roller pressing mechanism.
Figure 6:
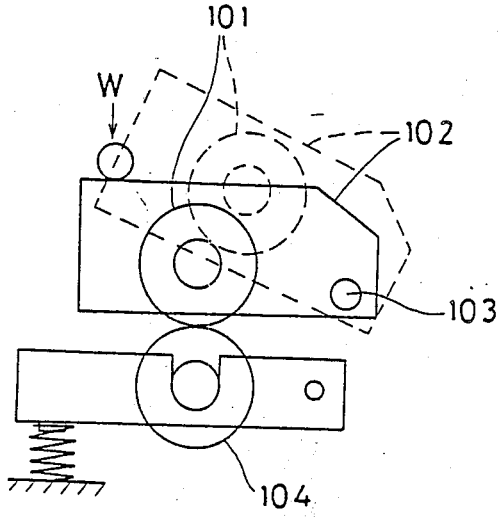
FIG. 6 is a schematic diagram of a conventional roller pressing mechanism.

In FIGS. 2 and 3, an upper fixing roller (9) and a lower fixing roller (10) form the fixation unit. Both ends of the lower roller (10) are supported by lower frames (13/13) pivotally held in place by a shaft (12) which is fixed to a projecting wall (11) of the lower body (1*b*). The lower frames (13/13) are supported by a compression coil spring (14) installed in the lower half (1*b*) so that the lower frames (13/13) can move vertically. The ends of the upper roller (9) are supported by upper frames (15/15) while the upper frames (15/15) are pivotally held by a shaft (16) fixed to the projecting wall (11) so that these frames can rotate. A rod (18) is installed between two side panels (17/17) that form the upper half (1*a*). When the upper half (1*a*) closes the rod (18) applies pressure to the upper frames (15/15), so that the upper roller (9) presses against the lower roller (10). Corresponding to the upper frames (15/15), vertical walls (19/19) are secured to the lower half (1*b*) while the ends of coupling members (20/20) are secured to the vertical walls (19/19). The upper frames (15/15) are provided with engaging holes (21/21) which engage with the coupling members (20/20) when the upper half (1*a*) is open (see FIG. 4). The coupling members (20/20) and the engaging holes (21/21) form means (22) to contact the upper roller (9) against the lower roller (10) so as to place them in a semi-pressure condition. When the upper half (1*a*) of the copying machine (1) is closed by rotating counterclockwise, as shown in FIG. 5, the rod (18) presses against the upper frame (15) allowing the load (W) of the upper half (1*a*) to press against the upper roller 9. As shown in the solid-line illustration in FIG. 5, the upper roller (9) consequently presses against the lower roller (10) by applying the specific predetermined pressure so that the fixing operation can be implemented.

If copying paper becomes clogged between the upper and lower rollers (9 and 10) and if the upper half (1*a*) is separated from the lower half, load W on the upper roller (9) of the upper half (1*a*) is eliminated, diminishing the pressure between the upper and lower rollers (9 and 10) to a level below that applied during the fixation operation. This allows the clogged paper to be easily removed from between the upper and lower rollers (9 and 10). When separating the upper half (1*a*), the upper roller, (9) through the force of the compressed coil spring (14) via the lower roller (10) and the lower frame (13), (9) moves upward together with the upper frame (15). However, when the upper roller (9) moves upward, the coupling members (20/20) engage with the engaging holes (21/21) in the upper frames (15/15) at the interim position indicated by the broken line in FIG. 5. In other words, even when no load W is applied to the upper roller (9), the upper and lower rollers (9 and 10) still remain in contact in the semi-pressed state by means of the energized force of the compressed coil spring (14). Thus, the copy is free of stains which would otherwise be caused by the upper roller (9) contacting the lower roller (10). In this mechanism, when the upper half (1*a*) remains in the completely open position, the coupling members (20/20) are disengaged from the engaging holes (21/21) so that the upper roller (9) can be released to a position completely separate from the lower roller (10) as illustrated by the line with dots in FIG. 5.

According to the construction of the fixing roller pressing mechanism in the preferred embodiment of the present invention, jammed paper can be removed very easily since the release of the upper half prevents application of load W on the upper roller (9). Also, since the upper roller (9) remains in contact with the lower roller (10) in the semi-pressed condition even when the upper half (1*a*) is raised, copy staining due to insufficient contact pressure can be avoided.

While only certain embodiments of the present invention have been described, it will be apparent to those skilled in the art that various changes and modifications may be made therein without departing from the spirit and scope of the present invention as claimed.

What is claimed is:

1. A fixing-roller pressing mechanism for a copying machine having an upper and lower half comprising:

a fixation unit including upper and lower fixing roller means:

a projecting wall means which projects upward from said lower half of said copying machine;

lower frame members pivotally held to said projecting wall means and supported by a compression means so that said lower frame member can move in a vertical direction, said lower frame member supporting said lower fixing roller means;

upper frame members pivotally held to said projecting wall means above said lower frame members, said upper frame members supporting said upper fixing roller means;

pressure member installed in said upper half of said copying machine, which causes said upper fixing roller means to press against said lower fixing roller means via said upper frame means when said upper half of said copy machine is closed; and means of retention installed between said lower and upper halves of said copy machine, which cause said upper fixing roller means to remain in a half-pressed condition against said lower fixing roller means when said upper half of said copy machine is open, said pressing condition allowing for clogged paper to be easily removed from said fixing rollers and prevents following copies from being stained by toner.

2. The fixing-roller pressing mechanism of a copying machine defined in claim 1 wherein said retention means is comprised of coupling members secured to said lower half of said copy machine and engaging holes in said upper frames so that said coupling members can be either engaged with or disengaged from said holes.

3. The fixing-roller pressing mechanism of a copy machine defined in claim 2 wherein said compression means comprises a coil spring.

* * * * *